United States Patent [19]

Mammino

[11] 4,294,904

[45] Oct. 13, 1981

[54] INDUCTIVE DEVELOPMENT MATERIALS FOR A MAGNETIC DEVELOPMENT PROCESS

[75] Inventor: Joseph Mammino, Penfield, N.Y.

[73] Assignee: Xerox Corporation, Stamford, Conn.

[21] Appl. No.: 96,593

[22] Filed: Nov. 21, 1979

[51] Int. Cl.[3] ..... G03G 13/09

[52] U.S. Cl. ..... 430/122; 430/107; 430/110

[58] Field of Search ..... 430/107, 110, 122, 39

[56] References Cited

U.S. PATENT DOCUMENTS

| | | | |
|---|---|---|---|
| 2,890,968 | 6/1959 | Giaimo | 430/107 X |
| 3,124,483 | 3/1964 | Rheinfrank | 430/107 X |
| 3,345,294 | 10/1967 | Cooper | 430/107 X |
| 3,909,258 | 9/1975 | Kotz | 430/107 X |
| 3,944,493 | 3/1976 | Jadwin et al. | 430/110 |
| 3,970,571 | 7/1976 | Olson et al. | 430/110 |
| 4,139,483 | 2/1979 | Williams et al. | 430/110 |

*Primary Examiner*—Richard L. Schilling
*Assistant Examiner*—John L. Goodrow
*Attorney, Agent, or Firm*—E. O. Palazzo; R. J. Grandmaison

[57] ABSTRACT

An inductive magnetic brush development process comprising forming an electrostatic latent image on a photoconductive surface and contacting the photoconductive surface with a developer mixture comprising electrically conductive carrier particles and magnetic toner particles comprising a resin material, a magnetic or magnetically-attractable material, and a triboelectric charge-enhancing additive.

8 Claims, No Drawings

INDUCTIVE DEVELOPMENT MATERIALS FOR A MAGNETIC DEVELOPMENT PROCESS

This invention relates to electrostatographic imaging systems, and more particularly, to improved xerographic developing materials, their manufacture, and use in the development of electrostatic latent images.

The formation and development of images on the surface of photoconductor materials by electrostatic means is well known. The basic xerographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic particles to the electrostatic latent image to be developed. One development method, as disclosed by E. N. Wise in U.S. Pat. No. 2,618,552, is known as "cascade" development. In this method, a developer material comprising relatively large carrier particles having finely-divided toner particles electrostatically coated thereon is conveyed to and rolled or cascaded across the electrostatic latent image bearing surface. The composition of the carrier particles is so selected as to triboelectrically charge the toner particles to the desired polarity. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier and excess toner are then recycled. This technique is extremely good for the development of line copy images.

Another method of developing electrostatic latent images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

There have been suggested systems for magnetic development not utilizing carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner made electrostatic transfer difficult.

A further development of magnetic development without carriers is illustrated by Kotz U.S. Pat. No. 3,909,258 wherein an electrostatic development process utilizing a magnetic brush without carrier is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is imbedded in the surface of the particle and then a small particle size $SiO_2$ agent is mixed into the toner to improve the flowability. The toner of Nelson suffers the disadvantages that it does not transfer well from a photoconductive substrate to plain bond paper.

Still another technique for developing electrostatic latent images is the "induction" process as disclosed, for example, in U.S. Pat. No. 2,824,813. In this technique, the process of xerography is modified by a step in which the electrostatic latent image induces an electrostatic image on another surface such as, for example, an adjacent conductive surface, and the induced image is developed or otherwise usefully employed. In the aforementioned patent, positioned to operate into the developing zone is a source of a charged cloud or mist of finely-divided particles such as a source of an electrostatically charged powder cloud.

In inductive development, the toner particles are normally loaded with a magnetic pigment to cause magnetic adhesion of the toner particles to carrier particles. Then, as the electrostatic imaging forces overcome the magnetic retaining forces, development takes place. Background development is suppressed by magnetic adhesion of the toner particles to the carrier particles and presumably developer triboelectric charging properties should not be an important factor in this development system. The assumption is that there is sufficient adhesion between the toner and carrier particles to prevent their separation during transport from the developer sump through nonmagnetized portions of the developer housing. The adhesion between the toner and carrier particles may occur either due to triboelectric charging or because of residual magnetization of the developer mixture.

However, in actual practice toner particles containing a relatively high content of a magnetic material, for example, magnetite, have been found to possess intrinsically low triboelectric charging characteristics regardless of whether employed with carrier particles possessing insulating or conductive characteristics.

Accordingly, there is a need for a developer mixture wherein the toner component is magnetizable and possesses sufficient triboelectric charging properties when employed with a conductive carrier component in inductive magnetic brush development of electrostatic latent images to enable the production of high quality images over an extended period of time. There also is a need for a toner material that will be properly charged triboelectrically and be held magnetically in a development process and continue to retain its charge after development so that it may be transferred electrostatically from a photoconductive surface to another permanent substrate such as paper.

SUMMARY OF THE INVENTION

It is therefore an object of this invention to provide developer materials which overcome the above-noted deficiencies.

It is a further object of this invention to provide a developer mixture which contains a triboelectrically charging toner and a conductive carrier matrial.

A further object of this invention is to provide improved developer materials which may be used in inductive magnetic brush development environments.

Another object of this invention is the provision of a magnetic toner material having improved triboelectric charging characteristics.

Another object of this invention is to provide developer materials having improved triboelectric characteristics and greatly increased useful life.

An additional object of this invention is the provision of electrostatographic developers which have excellent admix charging characteristics and rapid charging rates.

The above objects and others are accomplished by providing electrostatographic developer mixtures comprising finely-divided magnetic toner particles containing a triboelectric charge-enhancing material, and carrier particles possessing electrically conductive characteristics. More particularly, the magnetic toner particles of this invention comprise a magnetic or magnetically-attractable material, a resin material, and at least one triboelectric charge-enhancing additive. The developer mixtures of this invention are employed to develop electrostatic latent images by an inductive magnetic brush development process. The inductive magnetic brush development process depends on intense electric fields in the latent image areas to induce a charge on toner particles in the development zone. Normally, with insulating magnetic brush development, these fields are on the order of about one volt per micron. However, because conductive carrier particles are employed in the inductive magnetic brush development process and there may occur direct carrier particle contacts in a "bristle" in the development zone, the electric fields are enhanced to nearly air breakdown thresholds, that is, on the order of about 40 volts per micron. At these high fields, charge of either polarity can be induced into somewhat conductive toner particles which are in contact with the carrier particles.

Further, in accordance with this invention, where a conductive magnetic brush carrier material is combined with a magnetic toner material, it has also been found necessary in order to obtain satisfactory results by inductive magnetic brush development that the toner material acquire a triboelectric charge opposite to that of the electrostatic latent image by injection of charge through a conductive carrier material. As the carrier material is conductive, it is grounded or may be biased, and acquires its charge from the photoreceptor by induction.

Further, this development process is dependent upon the carrier material remaining conductive for proper operation and extended developer life. However, since most toner materials are made from thermoplastic, insulating resin compositions, developer failure occurs due to loss in carrier conductivity as the toner material becomes impacted on the carrier surface during machine operation. Also, although a triboelectric charging relationship between the toner and carrier material is not required per se for inductive magnetic brush development, it has now been found to be of great advantage to utilize the triboelectric charging properties of the developer materials to transport toner material from a remote developer sump to the active carrier material on a developer roll brush. Such triboelectric charging properties promote homogeneous mixing of toner and carrier material and maintain dust control.

Any suitable thermoplastic resin may be employed as part of the toner composition of the present invention; typical resins including for example, polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenically unsaturated mono-olefins such as ethylene, propylene, butylene and the like; vinyl esters such as vinyl chloride, vinyl bromide, vinyl fluoride, vinyl acetate, vinyl propionate, vinyl benzoate, vinyl butyrate and the like; esters of alpha methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate methyl alpha chloroacrylate methyl methacrylate, ethyl methacrylate, butyl methacrylate and the like; acrylonitrile, methacrylonitrile, acrylamide, vinyl ethers such as vinyl methyl ester, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the line; and mixtures thereof.

Generally, toner resins containing a relatively high percentage of styrene are preferred since greater image definition and density is obtained with their use. The styrene resin employed may be a homopolymer of styrene of styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably ether vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also, esterification products of a dicarboxylic acid and a diol comprising a diphenol may be used as a preferred resin material for the toner composition of the present invention. These materials are illustrated in U.S. Pat. No. 3,655,374 totally incorporated herein by reference, the diphenol reactant being of the formulas as shown in column 4, beginning at line 5 of this patent, and the dicarboxylic acid being of the formula as shown in column 6 of the above patent. The resin is present in an amount so that the total of all ingredients used in the toner total about 100 percent, thus when 5 percent by weight of the charge inducing material is used and 10 percent by weight of the pigment such as carbon block, about 85 percent by weight of resin material is used.

Optimum electrophotographic results are achieved with styrene butylmethacrylate copolymers, styrene vinyl toluene copolymers, styrene acrylate copolymers, polyester resins, predominantly styrene or polystyrene base resins as generally described in U.S. Pat. No. Re. 25,136 to Carlson and polystyrene blends as described in U.S. Pat. No. 2,788,288 to Rheinfrank and Jones.

Any suitable pigment or dye may be employed as the colorant for the toner particles, such materials being known and including for example, carbon black, magnetite, aniline blue, calco oil blue, chrome yellow, ultramarine blue. DuPont oil red, methylene blue chloride, phthalocyanine blue and mixtures thereof. The pigment or dye should be present in the toner and in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products, Inc. Preferably, the pigment is employed in amounts from about 3 percent to about 20 percent by weight based on the total weight of toner, however, if the colorant employed is a dye, substantially smaller quantities of the colorant may be used. Other pigments that may be useful include, for example, gilsonite, Prussian blue and various iron oxides. Generally, the toner materials have an average particle diameter of between about 5 and 15 microns. Satisfactory results are obtained when about 1 part by weight toner is used with about 10 to 200 parts by weight of carrier material.

The magnetic or magnetically-attractable component of the toner composition may comprise any suitable material which will provide the desired magnetic properties to the finely-divided toner particles. Typical of such materials are magnetite, ferrites, iron, and nickel. Preferred for the instant process are magnetite particles as they are black in color, low cost and provide excellent magnetic properties. The magnetite particles may be of any shape and any size which results in a toner particle with good magnetic properties. Generally, the particle size is between 0.02 micron and about 1 micron. A preferred average particle size for the magnetite particles is about 0.1 to about 0.6 micron average particle size. The particles may be acicular or cubic shaped. Satisfactory results are obtained when the amount of magnetic material present in the toner material is from between about 10 percent and about 80 percent by weight, based on the weight of the toner material. However, it is preferred that the amount of magnetic material present in the toner material be from between about 15 percent and about 50 percent by weight, based on the weight of the toner material, because such an amount provides satisfactory magnetic, color, and conductivity characteristics to the toner material with ease of preparation.

Any suitable triboelectric charge-enhancing additive may be present as a component in the toner compositions of this invention. Typical triboelectric charge-enhancing additives include alkyl pyridinium compounds such as cetyl pyridinium chloride; long chain hydrazinium compounds such as N,N-dimethyl, N-cetyl hydrazinium chloride, N,N-dimethyl N-lauryl hydrazinium bromide, N,N-dimethyl N-cetyl hydrazinium para-toluene sulfonate, N,N-dimethyl N-lauryl hydrazinium chloride, cetyl dimethyl hydrazinium chloride, cetyl dimethyl hydrazinium bromide, N,N-dimethyl N-stearyl hydrazinium para-toluene sulfonate, stearyl methyl benzyl hydrazinium nitrate; polyvinylpyridine salts such as a copolymer of polyvinylpyridine and poly-2-vinyl pyridine hydrogen chloride; quaternary ammonium compounds such as dimethyl distearyl ammonium chloride, tetraethylammonium bromide, tetraheptylammonium bromide, and longer chain quaternary ammonium salts commonly employed as antistatic agents in polymer systems such as trimethyl-n-propylammonium iodide, trimethylheptadecylamide n-propyl ammonium iodide, and dimethylhydroxyethylheptadecyl amido n-propyl ammonium nitrate; Color Index Solvent Black 5 azine spirit soluble Nigrosine black dyes such as Lake Blue Spirit Soluble, Nigrosine LSP Spirit Soluble, Nigrosine S, SSB, SSJ, SS Blue 40, SS Conce., SS Jet Shade, Nigrosine Spirit Soluble, Spirit Black CC, YS, and Spirit Nigrosine; polymers of vinyl pyrrolidone; dialkyl amido hydroxy ammonium compounds; alkyl picolinium compounds; alkyl morpholinium compounds; fluorosurfactants such as those comprising ionic solubilizing groups linked to highly branched perfluoro groups, e.g., ammonium perfluoroalkyl sulfonates, potassium perfluoroalkyl sulfonates, potassium fluorinated alkyl carboxylates, and ammonium perfluoroalkyl carboxylates commercially available under the tradenames Monflor from ICI America, Zonyl from E. I. du Pont, and Fluorad from 3M. These materials contain anionic, cationic or nonionic groups and provide a wide range of surface active behavior.

The amount of triboelectric charge-enhancing additive to be employed in the toner compositions of this invention can vary over wide ranges, but generally, any amount that results in a toner material that is charged to a level of at least about 15 microcoulombs per gram of toner is satisfactory. However, it is preferred that the amount of triboelectric charge-enhancing additive present be sufficient so that the toner material generates a charge of between about 15 microcoulombs and about 30 microcoulombs per gram of toner material because the charge level has been found effective to reduce toner powder clouding and provides good electrostatic adhesion with the carrier. In addition, the resistivity of the toner should be at least $10^{14}$ ohm-cm. Typically, from between about 0.25 percent and about 15 percent by weight, based on the weight of the toner composition, of triboelectric charge-enhancing additive is suitable for this purpose, however, the preferred amount is from between about 0.5 percent and about 5.0 percent based on the weight of the toner composition.

Numerous methods can be utilized to produce the toner materials of the present invention, one such method involving melting the resin and blending with a colorant, the magnetic particles, and the charge inducing material followed by solidification and mechanical attrition. Other methods include those well known in the art such as spray drying, melt dispersion and dispersion polymerization. For example, a solvent dispersion of resin, colorant, magnetic particles, and charge inducing material are spray dried under controlled conditions thereby resulting in the desired product. Such a toner prepared in this manner results in a magnetic and triboelectrically charging toner in relation to the carrier and these toners exhibit the improved properties as mentioned herein. The resultant toner particles are free-flowing and range in size from about 0.1 to about 30 microns. For maximum results, it is preferred that the finely-divided toner particles have an average particle size of from between about 5 microns and up to about 20 microns.

As earlier indicated, the foregoing toner compositions are employed with carrier particles having electrically conductive properties. The carrier particles of this invention may have an average diameter of from between about 30 microns and about 1,000 microns. Thus, any suitable solid material having electrically conductive properties may be employed as the carrier particles in this invention. In addition, it is preferred that the carrier particles be selected so that they acquire a triboelectric charge having a polarity opposite to that of the toner particles when brought into close contact therewith so that the toner particles adhere to and surround the carrier particles. In employing the carrier particles of this invention, it is also preferred that the carrier particles be selected so that the toner particles acquire a positive charge and the carrier particles acquire a negative triboelectric charge. Thus, by proper selection of the developer materials in accordance with their triboelectric properties, the polarities of their charge when mixed are such that the electroscopic toner particles adhere to and are coated on the surface of the carrier particles and also adhere to that portion of the electrostatic image-bearing surface having a greater attraction for the toner than the carrier particles.

In accordance with this invention, it is preferred that the carrier material comprise low density, porous, magnetic or magnetically-attractable metal particles having a gritty, oxidized surface and a high surface area, i.e., a surface area which is at least about 200 $cm^2$/gram and up to about 1300 $cm^2$/gram of carrier material. Typical satisfactory carrier materials include iron, steel, ferrite, magnetite, nickel and mixtures thereof. For ultimate use in an electrostatographic magnetic brush development system, it is preferred that the carrier materials have an average particle size of between about 30 microns and about 200 microns. Excellent results have been obtained when the carrier core materials comprise porous, sponge iron or steel grit. The carrier materials are generally produced by gas or water atomization processes or by reduction of suitable sized ore to yield sponge powder particles. The powders produced have a gritty surface, are porous, and have high surface areas. By comparison, conventional carrier materials usually have a high density and smooth surface characteristics.

In addition, the conductive carrier materials of this invention may comprise the aforementioned magnetic or magnetically-attractable metal particles having at least a partial coating of an electrically insulating resin composition. The conductive carrier materials having at least a partial coating of an electrically insulating resin composition are found to provide a more effective and rapid triboelectric charging rate and magnitude when mixed with the magnetic toner particles of this invention. Thus, where selected areas of the carrier material remain uncoated or exposed, the carrier material will possess electrically conductive properties when the core material comprises a conductive material. When such partially polymer coated carrier materials are provided, these carrier materials possess both electrically insulating and electrically conductive properties. Due to the electrically insulating properties of these carrier materials, the carrier materials provide desirably high triboelectric charging values when mixed with finely-divided toner particles.

The electrically insulating resin composition employed to provide at least a partial coating on the conductive carrier materials of this invention may be any suitable material. Typical insulating coating materials include vinyl chloride-vinyl acetate copolymers, styrene-acrylate-organosilicon terpolymers, natural resins such as caoutchouc, carnauba, colophony, copal, dammar, jalap, storax; thermoplastic resins including the polyolefins such as polyethylene, polypropylene, chlorinated poly-ethylene, chlorosulfonated polyethylene, and copolymers and mixtures thereof; polyvinyls and polyvinylidenes such as polystyrene, polymethyl-styrene, polymethyl methacrylate, polyacrylonitrile, polyvinyl acetate, polyvinyl alcohol, polyvinyl butyral, polyvinyl chloride, polyvinyl pyridine, polyvinyl carbazole, polyvinyl ethers, and polyvinyl ketones; polyamides such as polycaprolactam and polyhexamethylene adipamides; polyesters such as polyethylene terephthalate; polyurethanes; polysulfides, polycarbonates, thermosetting resins including phenolic resins such as phenol-formaldehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow et al in U.S. Pat. No. 3,526,433; and R. J. Hagenbach et al in U.S. Pat. No. 3,533,835 and 3,658,500. However, it is preferred that the coating material be of the type capable of providing negative triboelectric charging values to the carrier particle wherein the toner particles obtain a positive triboelectric charge for attraction of the toner particles to a negatively charged photoconductive surface. The preferred coating materials of this invention are selected from halogenated polymer compositions such as fluorocarbons including polytetrafluoroethylene, polyvinyl fluoride, polyvinylidene fluoride, polychlorotrifluoroethylene, fluorinated ethylene, fluorinated propylene, perfluoroalkoxy tetrafluoroethylene, polyvinyl chloride polyvinylidene chloride, trichlorofluoroethylene, and copolymers, mixtures, combinations, or derivatives thereof. In addition, the halogenated polymer compositions possess low friction properties and are especially desirable in reducing toner impaction, i.e., where toner particles become welded to or impacted upon the carrier particles during mixing therewith. The carrier particles of this invention have electrically conductive properties and are capable of generating a triboelectric charge of at least about 15 microcoulombs per gram of toner material when mixed therewith. When coated with a resinous coating material, the carrier particles should have a resistivity of less than about $10^{12}$ ohm-cm, and preferred between about $10^7$ ohm-cm and about $10^{10}$ ohm-cm.

In preparing the coated carrier particles, any suitable method may be employed to apply the coating material to the core particles. Typical coating methods include dissolving the coating material in a suitable solvent and exposing the core particles thereto followed by removal of the solvent such as by evaporation. Another method includes in-situ melt-fusing the coating material to the core particles. Suitable means to accomplish the foregoing include spray-drying apparatus, fluid-bed coating apparatus, and mixing apparatus such as available from Patterson-Kelley Co., East Stroudsburg, Pa.

The developer compositions of the instant invention may be employed to develop electrostatic latent images on any suitable electrostatic latent image-bearing surface including conventional photoconductive surfaces. Well known photoconductive materials include vitreous selenium, organic or inorganic photoconductors embedded in a nonphotoconductive matrix, organic or inorganic photoconductors embedded in a photoconductive matrix, or the like. Representative patents in which photoconductive materials are disclosed include U.S. Pat. No. 2,803,542 to Ullrich; U.S. Pat. No. 2,970,906 to Bixby; U.S. Pat. No. 3,121,006 to Middleton; U.S. Pat. No. 3,121,007 to Middleton; and U.S. Pat. No. 3,151,982 to Corrsin.

In the following examples, the relative triboelectric values generated by contact of carrier particles with toner particles is measured by means of a Faraday Cage. The device comprises a steel cylinder having a diameter of about one inch and a length of about one inch. A 400-mesh screen is positioned at each end of the cylinder. The cylinder is weighed, charged with about 0.5 gram mixture of carrier and toner particles and connected to ground through a capacitor and an electrometer connected in parallel. Dry compressed air is then blown through the steel cylinder to drive all the toner from the carrier. The charge on the capacitor is then read on the electrometer. Next, the chamber is reweighed to determine the weight loss. The resulting data is used to calculate the toner concentration and the charge in microcoulombs per gram of toner. Since the triboelectric measurements are relative, the measurements should, for comparative purposes, be conducted under substantially identical conditions.

DESCRIPTION OF PREFERRED EMBODIMENTS

The following examples further define, describe and compare methods of preparing the developer materials of the present invention and of utilizing them to develop electrostatic latent images. Parts and percentages are by weight unless otherwise indicated.

EXAMPLE I

A control developer mixture was prepared as follows. A toner composition was prepared comprising about 8 percent furnace carbon black commercially available from Columbian Carbon Company of New York, N.Y., about 49 percent of styrene-n-butyl methacrylate 58/42 copolymer resin and about 43 percent of magnetite particles commercially available as K378 from Northern Pigments Ltd., Toronto, Canada by melt-blending the ingredients followed by mechanical attrition to yield toner particles having an average diameter of about 13 microns.

The carrier particles comprised about 99.8 parts of oxidized atomized iron carrier cores available from Hoeganaes Corporation, Riverton, N.J. having an average particle diameter of about 160 microns. A coating composition comprising about 0.2 parts of polyvinylidene fluoride commercially available as Kynar 201 from Pennwalt Corporation, King of Prussia, Pa., was applied to the carrier cores by dry-mixing and heat fusion. About three parts by weight of the toner composition was mixed with about 100 parts by weight of the carrier particles to form a developer mixture.

The developer mixture was mixed for 30, 60, and 180 minutes after which time periods it was evaluated for triboelectric charging response pursuant to the aforementioned method. It was found that the toner particles generated a triboelectric charge of about 5.4, 5.2, and 3.8 microcoulombs per gram of toner after the respective time periods disclosed.

It was concluded that the high magnetite content provides low triboelectric charging toners. In addition, the developer provided a poor mixture in that the toner material produced numerous large clumps of toner particles. Such toner clumps are known to cause imaging defects. When tested in an electrostatographic machine, it was found that a substantial portion of the toner material adhered to and was lost to the developer housing walls or remained as loose powder in the developer sump.

EXAMPLE II

A developer mixture was prepared as follows. A toner composition was prepared comprising about 8 percent furnace carbon black commercially available from Columbian Carbon Company of New York, N.Y., 39 percent of a styrene-n-butyl methacrylate 58/42 copolymer resin, about 50 percent of magnetite particles commercially availabe as K-378 from Northern Pigments Ltd., Toronto, Canada and about 3 percent of a triboelectric charge enhancing additive consisting of Nigrosine SSB commercially available from American Cyanamid Corporation, Bound Brook, N.J. After melting the copolymer resin, the carbon black, the magnetite particles and the Nigrosine dye were thoroughly blended therewith, the mixture allowed to solidify, and then followed by mechanical attrition to yield toner particles having an average diameter of about 13 microns.

The carrier particles were essentially the same composition as in Example I. About three parts by weight of this toner composition was mixed with about 100 parts by weight of the carrier particles to form a developer mixture. The developer mixture was mixed for 30, 60, and 180 minutes after which time periods it was evaluated for triboelectric charging response pursuant to the aforementioned method. It was found that the toner particles generated a triboelectric charge of about 21.6, 19.1, and 17.4 microcoulombs per gram of toner after the respective time periods disclosed.

Thus, the addition of 3 weight percent Nigrosine SSB dye internally added and dispersed in the toner composition provides a toner material exhibiting high triboelectric charging values. For example, the triboelectric charging values obtained with the present developer mixture are about three times greater than the non-Nigrosine containing toner material of Example I. In addition, the toner material obtained a positive polarity triboelectric charge and the developer remained electrically conductive.

EXAMPLE III

A developer mixture was prepared as follows. A toner composition was prepared comprising about 72 percent of a styrene-n-butyl methacrylate 58/42 copolymer resin, about 25 percent of magnetite particles commercially available as MO4431 from Pfizer Inc., New York, N.Y., and about 3 percent of a triboelectric charge enhancing additive consisting of Nigrosine SSB commercially available from American Cyanamid Corporation, Bound Brook, N.J. After melting the cpolymer resin, the magnetite particles and the Nigrosine dye were thoroughly blended therewith, the mixtured allowed to solidify, and then followed by mechanical attrition to yield toner particles having an average diameter of about 13 microns.

The carrier particles were essentially the same composition as in Example I. About three parts by weight of this toner composition was mixed with about 100 parts by weight of the carrier particles to form a developer mixture. The developer mixture was mixed for 30, 60, and 180 minutes after which time periods it was evaluated for triboelectric charging response pursuant to the aforementioned method. It was found that the toner particles generated a triboelectric charge of about 29.7, 29.2, and 27.4 microcoulombs per gram of toner after the respective time periods disclosed.

EXAMPLE IV

A developer mixture was prepared as follows. A toner composition was prepared comprising about 72 percent of a styrene-n-butyl methacrylate 58/42 copolymer resin, about 25 percent of magnetite particles commercially available as MO4432 from Pfizer Inc., New York, N.Y., and about 3 percent of a triboelectric charge enhancing additive consisting of Nigrosine SSB commercially available from American Cyanamid Corporation, Bound Brook, N.J. After melting the copolymer resin, the magnetite particles and the Nigrosine dye were thoroughly blended therewith, the mixture allowed to solidify, and then followed by mechanical attrition to yield toner particles having an average diameter of about 13 microns.

The carrier particles were essentially the same composition as in Example I. About three parts by weight of this toner composition was mixed with about 100 parts by weight of the carrier particles to form a developer mixture. The developer mixture was mixed for 30, 60, and 180 minutes after which time periods it was evaluated for triboelectric charging response pursuant to the aforementioned method. It was found that the toner particles generated a triboelectric charge of about 30.3, 25.0, and 25.5 microcoulombs per gram of toner after the respective time periods disclosed.

EXAMPLE V

A developer mixture was prepared as follows. A toner composition was prepared comprising about 47 percent of a styrene-n-butyl methacrylate 58/42 copolymer resin, about 50 percent of magnetite particles commercially available as K-378 from Northern Pigments Ltd., Toronto, Canada and about 3 percent of a triboelectric charge enhancing additive consisting of cetyl pyridinium chloride monohydrate commercially available from the Hexcel Corporation, Lodi, N.J. After melting the copolymer resin, the magnetite particles and the cetyl pyridinium chloride were thoroughly blended therewith, the mixture allowed to solidify, and then followed by mechanical attrition to yield toner particles having an average diameter of about 13 microns.

The carrier particles were essentially the same composition as in Example I. About three parts by weight of this toner composition was mixed with about 100 parts by weight of the carrier particles to form a developer mixture. The developer mixture was mixed for 30, 60, and 180 minutes after which time periods it was evaluated for triboelectric charging response pursuant to the aforementioned method. It was found that the toner particles generated a triboelectric charge of about 20, 19, and 16 microcoulombs per gram of toner after the respective time periods disclosed.

Although specific materials and conditions are set forth in the foregoing examples, these are merely intended as illustrations of the present invention. Various other suitable thermoplastic toner resin components, additives, colorants, and development processes such as those listed above may be substituted for those in the examples with similar results. Other materials may also be added to the toner or carrier to sensitize, synergize or otherwise improve the fusing properties or other desirable properties of the system.

Other modifications of the present invention will occur to those skilled in the art upon a reading of the present disclosure. These are intended to be included within the scope of this invention.

What is claimed is:

1. A magnetic brush inductive development process comprising the steps of providing an electrostatographic imaging member having a recording surface, forming an electrostatic latent image on said recording surface, and contacting the recording surface with an electrostatographic developer mixture comprising electrically conductive carrier particles and a finely-divided toner composition, said toner composition comprising a colorant, a thermoplastic resin, a magnetic or magnetically attractable material, present in an amount of from about 10% to about 80% by weight, and being selected from the group consisting of magnetite, ferrites, iron, and nickel, and a triboelectric charging-enhancing material dispersed in the toner composition, present in an amount of between about 0.25% to about 15% by weight, and selected from the group consisting of alkyl pyridinium compounds, long chain hydrazinium compounds, quaternary ammonium compounds, and fluorosurfactants comprising ionic solubilizing groups linked to highly branched perfluoro groups, said toner composition being characterized as possessing triboelectric charging properties such that it is charged to a level of from about 15 microcoulombs per gram to about 30 microcoulombs per gram of toner composition, a resistivity of at least $10^{14}$ ohm-cm, and promotes homogeneous mixing of said toner composition with said carrier particles thereby improving transport of the toner particles and avoiding clumping of the toner particles, whereby at least a portion of said finely-divided toner composition is attracted to and deposited on said recording surface in conformance with said electrostatic image.

2. A magnetic brush inductive development process in accordance with claim 1 wherein said magnetic or magnetically-attractable material is selected from the group consisting of magnetite, ferrites, iron, and nickel.

3. A magnetic brush inductive development process in accordance with claim 1 wherein said carrier particles have an average diameter of from between about 30 microns and about 1,000 microns and are selected from the group consisting of iron, steel, ferrite, magnetite, nickel and mixtures thereof.

4. A magnetic brush inductive development process in accordance with claim 1 wherein said carrier particles have at least a partial coating of an electrically insulating resin composition.

5. A magnetic brush inductive development process in accordance with claim 4 wherein said electrically insulating resin composition comprises a halogenated polymer selected from the group consisting of polytetrafluoroethylene, polyvinylidene fluoride, polychloroetrifluoroethylene, and perfluoroalkoxy tetrafluoroethylene.

6. A magnetic brush inductive development process in accordance with claim 1 wherein said carrier particles have a resistivity of less than about $10^{12}$ ohm-cm.

7. A process in accordance with claim 1 wherein the charge enhancing material is cetyl pyridinium chloride.

8. A process in accordance with claim 1 wherein the carrier particles have an average diameter of from between about 30 microns and 1,000 microns, and consist of materials selected from iron, steel, ferrite, magnetite, nickel and mixtures thereof.

* * * * *